United States Patent [19]

Hiraishi et al.

[11] Patent Number: 4,644,374

[45] Date of Patent: Feb. 17, 1987

[54] HEAT-SENSITIVE RECORDING MATERIAL

[75] Inventors: Shigetoshi Hiraishi; Kazuyoshi Kondo, both of Tokyo; Takashi Banba, Kyoto, all of Japan

[73] Assignee: Mitsubishi Paper Mills, Ltd., Tokyo, Japan

[21] Appl. No.: 763,410

[22] Filed: Aug. 7, 1985

[30] Foreign Application Priority Data

Aug. 10, 1984 [JP] Japan ..... 59-167388

[51] Int. Cl.[4] ..... B41M 5/18

[52] U.S. Cl. ..... 346/209; 346/208; 346/216; 346/217; 346/221; 427/150; 427/151

[58] Field of Search ..... 346/208, 209, 216, 217, 346/221, 225; 427/150, 151, 152

[56] References Cited

U.S. PATENT DOCUMENTS 4,467,338 8/1984 Hiraishi ..... 346/209

4,473,831 9/1984 Watanabe ..... 346/209

*Primary Examiner*—Bruce H. Hess

*Attorney, Agent, or Firm*—Cushman, Darby & Cushman

[57] ABSTRACT

When, in a heat-sensitive recording material comprising a substrate and a heat-sensitive recording layer provided on the substrate and containing an ordinarily colorless or light-colored dye precursor and a color developer capable of allowing the dye precursor to develop a color by reacting with the dye precursor when heated, the heat-sensitive recording layer further contains 1,2,3-tris(3-butyl-4-hydroxy-6-methylphenyl)-butane, the resulting heat-sensitive recording material has excellent sensitivity and image stability.

8 Claims, No Drawings

HEAT-SENSITIVE RECORDING MATERIAL

BACKGROUND OF THE INVENTION

1. Field of the Invention

This invention relates to a heat-sensitive recording material. More particularly, the present invention relates to a heat-sensitive recording material with excellent sensitivity and recorded image stability.

2. Description of the Prior Art

Heat-sensitive recorded materials generally comprise a substrate and a heat-sensitive recording layer provided on the substrate and containing, as main components, an ordinarily colorless or light-colored, electron-donating dye precursor and an electron-accepting color developer. When these materials are heated by a thermal head, a thermal pen, a laser beam or the like, the dye precursor and the color developer react with each other momentarily to form an image. They are disclosed in, for example, Japanese Patent Publication Nos. 4160/1968 and 14039/1970. Such heat-sensitive recording materials have various advantages such as records can be obtained by the use of relatively simple equipment, the maintenance of the equipment is easy and the equipment generates no noise; therefore, the recording materials are in wide use in such fields as recorders for measurement, facsimiles, printers, terminal equipments for computers, labels, automatic ticket machines and the like.

Heat-sensitive recording materials are required to have, as basic properties, sufficient image development sensitivity, sufficient developed image density, no deterioration of developed image with the lapse of time, etc. As the heat-sensitive recording materials have come in recent years to be used widely, they are required to further have image retainability such as image stability against oily matters (e.g. hairdressings, hand creams and oils and fats contained in sweat) adhered to the image, namely, grease resistance.

Adding a phenol type anti-oxidant to heat-sensitive recording materials as a stabilizer for improvement of retainability of the recorded image formed by these heat-sensitive recording materials is described in Japanese Patent Application Kokai (Laid-open) Nos. 45747/1974, 18752/1979 and 83495/1982. However, none of these approaches provides an additive which gives satisfactory image stability without reducing sensitivity.

SUMMARY OF THE INVENTION

Accordingly, the object of the present invention is to provide a heat-sensitive recording material excellent in sensitivity and recorded image stability.

The present inventors made a study to achieve the above object and, as a result, found that a heat-sensitive recording material excellent in sensitivity and recorded image stability can be obtained by using 1,2,3-tris(3-t-butyl-4-hydroxy-6-methylphenyl)butane. Based on this finding, the present invention has been completed.

Hence, the present invention resides in a heat-sensitive recording material comprising a substrate and a heat-sensitive recording layer provided on the substrate and containing an ordinarily colorless or light-colored dye precursor and a color developer capable of allowing the dye precursor to develop a color by reacting with the dye precursor when heated, the heat-sensitive recording layer further containing, as a stabilizer, 1,2,3-tris(3-t-butyl-4-hydroxy-6-methylphenyl)butane.

The stabilizer used in the heat-sensitive recording material of the present invention greatly contributes to the improvement of recorded image stability as compared with conventionally known bisphenol type stabilizers. The stabilizer used in the present invention has been found to be very effective particularly for prevention of image deterioration caused when a recorded image is touched long by hands stained with hairdressings or oils; that is, the stabilizer of the present invention has been found to be excellent in grease resistance of recorded image. Further, the stabilizer according to the present invention, having a low melting point of 137° to 139° C., is advantageous also in matchability or adaptability with a thermal pen or a thermal head as well as sensitivity.

DETAILED DESCRIPTION OF THE INVENTION

The stabilizer used in the present invention, namely, 1,2,3-tris(3-t-butyl-4-hydroxy-6-methylphenyl)butane is preferably used in an amount of 10 to 250% by weight based on dye precursor. A particularly preferable range is 25 to 200% by weight. When the addition amount is less than 10% by weight, the addition effect is very small. When the addition amount exceeds 250% by weight, the dilution effect becomes large; the image density is affected badly; and the addition is not economical.

The main components used in the heat-sensitive recording material according to the present invention will be explained specifically; however, the components usable in the recording material are not restricted to these substances as long as the purport of the present invention is maintained.

As the dye precursor, there are mentioned triphenylmethane compounds, fluoran compounds, diphenylmethane compounds, thiazine compounds, spiropyran compounds, etc. Specific examples of these compounds include 3,3-bis(p-dimethylaminophenyl)-6-dimethylaminophthalide, 3-(4-diethylamino-2-ethoxyphenyl)-3-(1-ethyl-2-methylindole-3-yl)-4-azaphthalide, 3-diethylamino-6-methyl-7-chlorofluoran, 3-diethylamino-7-chlorofluoran, 3-(N-cyclohexylamino)-7-methylfluoran, 3-diethylamino-7-methylfluoran, 3-diethylamino-6-chloro-7-methylfluoran, 3-diethylamino-7-anilinofluoran, 3-diethylamino-6-methyl-7-dibenzylaminofluoran, 3-(N-ethyl-p-toluidino)-7-anilinofluoran, 3-diethylamino-7-(o-chloroanilino)fluoran, 3-dibutylamino-7-(o-chloroanilino)fluoran, 3-(N-ethyl-p-toluidino)-6-methyl-7-anilinofluoran, 3-diethylamino-7-(m-trifluoromethylanilino) fluoran, 3-diethylamino-6-methyl-7-(p-phenetidino)fluoran, 3-di-n-butylamino-7-(o-fluoroanilino)fluoran, 3-diethylamino-6-methyl-7-anilinofluoran, 3-(N-methyl-N-cyclohexylamino)-6-methyl-7-anilinofluoran, 3-piperidino-6-methyl-7-anilinofluoran, 3-pyrrolidino-6-methyl-7-anilinofluoran, and 3-(N-ethyl-N-isopentylamino)-6-methyl-7-anilinofluoran. Of these dye precursors, the last five fluorans are included in the compounds represented by the general formula

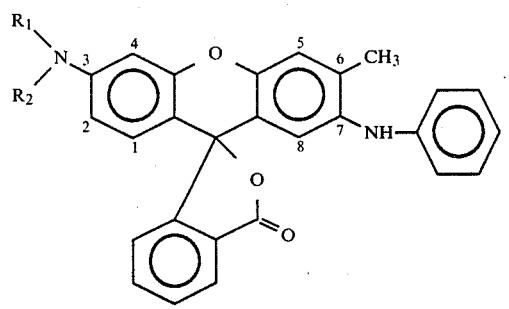

(wherein $R_1$ and $R_2$ are each an alkyl group of 1 to 5 carbon atoms or a cycloalkyl group, or $R_1$ and $R_2$ may form a ring) and can be preferably used in the present invention.

The dye precursors particularly preferably used in the present invention are 3-diethylamino-6-methyl-7-anilinofluoran, 3-(N-methyl-N-cyclohexylamino)-6-methyl-7-anilinofluoran and 3-(N-ethyl-N-isopentylamino)-6-methyl-7-anilinofluoran.

As the color developer, there are generally used acidic substances employed in heat-sensitive papers, namely, electron-accepting compounds, particularly phenol derivatives and aromatic carboxylic acid derivatives. Preferable of the phenol derivatives are compounds having at least one phenolic hydroxyl group, and more preferable are phenol derivatives both or either one of whose phenolic hydroxyl groups at o-positions is unsubstituted. Examples of these phenol derivatives include phenol, p-t-butylphenol, p-phenylphenol, naphthol, p-hydroxyacetophenone, 2,2'-biphenol, 4,4'-isopropylidenediphenol, 4,4'-isopropylidenebis(2-methylphenol), 4,4'-isopropylidenebis(2-t-butylphenol), 4,4'-isopropylidenebis(2-chlorophenol), 4,4'-cyclohexylidenediphenol, 2,2-bis(4-hydroxyphenyl)butane, 2,2-bis(4-hydroxyphenyl)pentane, 2,2-bis(4-hydroxyphenyl)hexane, diphenol acetic acid methyl ester, diphenol sulfone, bis(3-allyl-4-hydroxyphenyl)sulfone, 4-hydroxy-4'-methyldiphenyl sulfone, 4-hydroxy-4'-isopropyloxydiphenyl sulfone, diphenol sulfide, 4,4'-thiobis(6-t-butyl-2-methyl)phenol and novolak type phenol resins. As the aromatic carboxylic acid derivatives, there are mentioned, for example, benzoic acid, p-t-butylbenzoic acid, p-hydroxybenzoic acid, methyl p-hydroxybenzoate, isopropyl p-hydroxybenzoate, benzyl p-hydroxybenzoate, lauryl gallate, stearyl gallate, salicylanilide, 5-chlorosalicylanilide, metal (e.g. zinc) salts of 5-t-bytylsalicylic acid and metal (e.g. zinc) salts of hydroxynaphthoic acid.

Particularly preferable of the above mentioned color developers are benzyl p-hydroxybenzoate, 4,4'-isopropylidenediphenol, bis(3-allyl-4-hydroxyphenyl) sulfone and 4-hydroxy-4'-isopropyloxydiphenyl sulfone.

As the binder, there are mentioned, for example, water-soluble binders such as starch, hydroxyethyl cellulose, methyl cellulose, carboxymethyl cellulose, gelatin, casein, a polyvinyl alcohol, a modified polyvinyl alcohol, a styrene-maleic anhydride copolymer, an ethylene-maleic anhydride copolymer and the like, as well as water-insoluble binders such as a styrene-butadiene copolymer, an acrylonitrile-butadiene copolymer, a methyl acrylatebutadiene copolymer and the like, said water-insoluble binders being used in latex form.

As the pigment, there are mentioned, for example, diatomaceous earth, talc, kaolin, calcinated kaolin, calcium carbonate, magnesium carbonate, titanium oxide, zinc oxide, silicon oxide, aluminum hydroxide and an ureaformalin resin.

Besides, there are mentioned a substance for preventing head wear or sticking (e.g. a metal salt of a higher fatty acid such as zinc stearate, calcium stearate or the like, or a wax such as paraffin, oxidized paraffin, a polyethylene, an oxidized polyethylene, stearamide, castor wax or the like), a dispersing agent (e.g. sodium dioctylsuccinate), an ultraviolet absorber (e.g. benzophenone type or benzotriazole type), a surfactant, a fluorescent dye, etc.

As the substrate used in the heat-sensitive recording material according to the present invention, paper is used in most cases. However, there can be optionally used various unwoven cloths, plastic films, synthetic papers, metal foils, and their composite sheets.

The present invention will be explained in more detail referring to Examples; however, the present invention is not restricted to the Examples.

EXAMPLE 1

20 g of 3-diethylamino-6-methyl-7-anilinofluoran, together with 60 g of an aqueous solution containing 2% of a polyvinyl alcohol, was subjected to grinding by a ball mill for 24 hr to obtain a dispersion.

Separately, 50 g of benzyl p-hydroxybenzoate and 20 g of 1,2,3-tris(3-t-butyl-4-hydroxy-6-methylphenyl)butane, together with 210 g of an aqueous solution containing 2% of a polyvinyl alcohol, were subjected to grinding by a ball mill for 24 hr to obtain a dispersion.

These two dispersions were mixed. Thereto were added 100 g of a dispersion containing 50% of calcium carbonate, 50 g of a dispersion containing 20% of zinc stearate, 250 g of an aqueous solution containing 12% of a polyvinyl alcohol and 230 g of water. They were stirred to obtain a coating fluid.

This coating fluid was coated on a base paper of 50 g/m$^2$ so that the amount of the dye precursor became 0.5 g/m$^2$, and then dried. The resulting paper was subjected to super calender treatment to obtain a heat-sensitive recording material.

COMPARATIVE EXAMPLE 1

A heat-sensitive recording material was obtained in the same manner as in Example 1 except that 1,2,3-tris(3-t-butyl-4-hydroxy-6-methylphenyl)butane was not used.

COMPARATIVE EXAMPLE 2

A heat-sensitive recording material was obtained in the same manner as in Example 1 except that 20 g of 1,2,3-tris(3-t-butyl-4-hydroxy-6-methylphenyl)butane used in Example 1 was replaced by 20 g of 4,4'-butylidenebis(2-t-butyl-5-methylphenol).

TESTS

The heat-sensitive recording materials obtained in Example 1 and Comparative Examples 1 and 2 were subjected to recording by a thermal facsimile (FUJITSU FACOM FAX 621C) to develop an image. The developed images were subjected to the following characteristic and stability tests. The results are shown in Table 1. In measurement of image density, a Macbeth densitometer RD 514 was used.

(a) Image density (b) Heat resistance: Image density after storage at 60° C. for 24 hr was measured and image retention (%) was calculated from the following formula.

Image retention (%) =

(Image density after storage)/(image density before storage) × 100

(c) Grease resistance: An image portion was strongly pressed down by the inner surface of a finger and then was allowed to stand for 120 days at room temperature. Subsequently, the image density was measured and the image retention (%) was calculated in the same manner as in the above test (b).

TABLE 1

| | Test | | |
|---|---|---|---|
| | (a) Image density | (b) Heat resistance Image retention (%) | (c) Grease resistance Image retention (%) |
| Example 1 | 1.24 | 100 | 82 |
| Comparative Example 1 | 1.24 | 79 | 16 |
| Comparative Example 2 | 1.25 | 93 | 26 |

As is appreciated from Table 1, the stabilizer used in the heat-sensitive recording material of the present invention improves image stability without reducing image development sensitivity.

EXAMPLE 2

A heat-sensitive recording material was obtained in the same manner as in Example 1 except that 50 g of benzyl p-hydroxybenzoate used in Example 1 was replaced by 40 g of 4,4'-isopropylidenedipenol and 10 g of stearamide. This material was subjected to recording and the developed image was subjected to the stability tests. As in Example 1, the image had excellent stability.

EXAMPLE 3

A heat-sensitive recording material was obtained in the same manner as in Example 1 except that 20 g of 3-diethylamino-6-methyl-7-anilinofluoran was replaced by 20 g of 3-(N-ethyl-N-isopentylamino)-6-methyl-7-anilinofluoran, and 50 g of benzyl p-hydroxybenzoate was replaced by 50 g of bis(3-allyl-4-hydroxyphenyl) sulfone. This material was subjected to recording and the developed image was subjected to the stability tests. As in Example 1, the image had excellent stability.

EXAMPLE 4

A heat-sensitive recording material was obtained in the same manner as in Example 1 except that 20 g of 3-diethylamino-6-methyl-7-anilinofluoran used in Example 1 was replaced by 20 g of 3-(N-methyl-N-cyclohexylamino)-6-methyl-7-anilinofluoran. This material was subjected to recording and the developed image was subjected to the stability tests. As in Example 1, the image had excellent stability.

EXAMPLE 5

A heat-sensitive recording material was obtained in the same manner as in Example 3 except that 50 g of bis(3-allyl-4-hydroxyphenyl) sulfone used in Example 3 was replaced by 50 g of 4-hydroxy-4'-isopropyloxydiphenyl sulfone. This material was subjected to recording and the developed image was subjected to the stability tests. As in Example 1, the image had excellent stability.

What is claimed is:

1. A heat-sensitive recording material comprising a substrate and a heat-sensitive recording layer provided on the substrate and containing an ordinarily colorless or light-colored dye precursor and a color developer capable of allowing the dye precursor to develop a color by reacting with the dye precursor when heated, the heat-sensitive recording layer further containing 1,2,3-tris(3-t-butyl-4-hydroxy-6-methylphenyl)butane.

2. A heat-sensitive recording material according to claim 1, wherein the amount of 1,2,3-tris(3-t-butyl-4-hydroxy-6-methylphenyl)butane is 10 to 250% by weight based on the dye precursor.

3. A heat-sensitive recording material according to claim 2, wherein the amount of 1,2,3-tris(3-t-butyl-4-hydroxy-6-methylphenyl)butane is 25 to 200% by weight based on the dye precursor.

4. A heat-sensitive recording material according to claim 1, wherein the dye precursor is selected from the group consisting of 3-diethylamino-6-methyl-7-anilinofluoran, 3-(N-ethyl-N-isopentylamino)-6-methyl-7-anilinofluoran and 3-(N-methyl-N-cyclohexylamino)-6-methyl-7-anilinofluoran.

5. A heat-sensitive recording material according to claim 1, wherein the color developer is selected from the group consisting of benzyl p-hydroxybenzoate, 4,4'-isopropylidenedipenol, bis(3-allyl-4-hydroxyphenyl) sulfone and 4-hydroxy-4'-isopropyloxydiphenyl sulfone.

6. A heat-sensitive recording material according to claim 1, wherein the dye precursor is 3-diethylamino-6-methyl-7-anilinofluoran and the color developer is selected from the group consisting of benzyl p-hydroxybenzoate, 4,4'-isopropylidenediphenol, bis(3-allyl-4-hydroxyphenyl) sulfone and 4-hydroxy-4'-isopropyloxydiphenyl sulfone.

7. A heat-sensitive recording material according to claim 1, wherein the dye precursor is 3-(N-ethyl-N-isopentylamino)-6-methyl-7-anilinofluoran and the color developer is selected from the group consisting of benzyl p-hydroxybenzoate, 4,4'-isopropylidenediphenol, bis(3-allyl-4-hydroxyphenyl) sulfone and 4-hydroxy-4'-isopropyloxydiphenyl sulfone.

8. A heat-sensitive recording material according to claim 1, wherein the dye precursor is 3-(N-methyl-N-cyclohexylamino)-6-methyl-7-anilinofluoran and the color developer is selected from the group consisting of benzyl p-hydroxynenzoate, 4,4'-isopropylidenediphenol, bis(3-allyl-4-hydroxyphenyl) sulfone, and 4-hydroxy-4'-isopropyloxydiphenyl sulfone.

* * * * *